US008485251B2

(12) United States Patent
Benischek et al.

(10) Patent No.: US 8,485,251 B2
(45) Date of Patent: Jul. 16, 2013

(54) ELECTROMAGNETIC BASED SYSTEM AND METHOD FOR ENHANCING SUBSURFACE RECOVERY OF FLUID WITHIN A PERMEABLE FORMATION

(75) Inventors: Vincent Benischek, Shrub Oak, NY (US); Michael Currie, New Hyde Park, NY (US); Rajneeta Basantkumar, Mineola, NY (US); Gennady Lyasko, Freehold, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 203 days.

(21) Appl. No.: 12/545,066

(22) Filed: Aug. 20, 2009

(65) Prior Publication Data

US 2010/0071894 A1 Mar. 25, 2010

Related U.S. Application Data

(60) Provisional application No. 61/090,529, filed on Aug. 20, 2008, provisional application No. 61/090,533, filed on Aug. 20, 2008, provisional application No. 61/090,536, filed on Aug. 20, 2008, provisional application No. 61/090,542, filed on Aug. 20, 2008.

(51) Int. Cl.
*E21B 43/00* (2006.01)

(52) U.S. Cl.
USPC ..... 166/248

(58) Field of Classification Search
USPC ..... 166/248
See application file for complete search history.

(56) References Cited

U.S. PATENT DOCUMENTS

| | | | | |
|---|---|---|---|---|
| 2,015,401 | A | 9/1935 | Jakosky | |
| 3,085,197 | A | 4/1963 | Hings | |
| 3,943,436 | A | 3/1976 | Pirson et al. | |
| 4,140,179 | A * | 2/1979 | Kasevich et al. | 166/248 |
| 4,298,967 | A | 11/1981 | Hawkins | |
| 4,620,593 | A * | 11/1986 | Haagensen | 166/248 |
| 4,627,036 | A | 12/1986 | Wyatt | |
| 4,641,099 | A * | 2/1987 | Lee et al. | 324/323 |
| 4,705,108 | A | 11/1987 | Little et al. | |
| 5,065,819 | A | 11/1991 | Kasevich | |
| 5,109,927 | A | 5/1992 | Supernaw et al. | |
| 5,152,341 | A * | 10/1992 | Kasevich | 166/248 |

(Continued)

FOREIGN PATENT DOCUMENTS

WO 00/57021 A1 9/2000

OTHER PUBLICATIONS

R. Tao and X. Xu, Reducing the Viscosity of Crude Oil by Pulsed Electric or Magnetic Field, Feb. 17, 2006, Energy and Fuels, 20, 2046-2051.*

(Continued)

*Primary Examiner* — Shane Bomar
*Assistant Examiner* — Silvana Runyan
(74) *Attorney, Agent, or Firm* — Howard IP Law Group, PC

(57) ABSTRACT

Systems and methods of enhancing crude oil flow radiate electromagnetic energy in the form of focused far field electromagnetic energy into a permeable formation containing the crude oil so as to cause the oil to decrease in viscosity without a substantial change in temperature of the crude oil, increasing the ability of the oil to flow within the formation toward the well and enabling recovery from the reservoir.

20 Claims, 5 Drawing Sheets

U.S. PATENT DOCUMENTS

| | | | | |
|---|---|---|---|---|
| 5,236,039 | A | 8/1993 | Edelstein et al. | |
| 5,293,936 | A * | 3/1994 | Bridges | 166/248 |
| 5,495,259 | A * | 2/1996 | Lyasko | 343/788 |
| 6,651,739 | B2 | 11/2003 | Arndt et al. | |
| 7,091,460 | B2 | 8/2006 | Kinzer | |
| 7,191,063 | B2 * | 3/2007 | Tompkins | 702/2 |
| 7,244,694 | B2 | 7/2007 | Fu et al. | |
| 7,400,976 | B2 | 7/2008 | Young et al. | |
| 7,519,474 | B2 | 4/2009 | Zhou et al. | |
| 2004/0239330 | A1 | 12/2004 | Weaver et al. | |
| 2005/0199386 | A1 | 9/2005 | Kinzer | |
| 2006/0283598 | A1 | 12/2006 | Kasevich | |
| 2007/0137858 | A1 * | 6/2007 | Considine et al. | 166/248 |
| 2008/0135237 | A1 | 6/2008 | Dubost et al. | |
| 2008/0288173 | A1 | 11/2008 | Saenger | |
| 2009/0321132 | A1 | 12/2009 | Ouellet et al. | |
| 2010/0198638 | A1 | 8/2010 | Deffenbaugh et al. | |

OTHER PUBLICATIONS

International Search Report dated Nov. 10, 2009 in related Application No. PCT/US2009/054553.

* cited by examiner

ELECTROMAGNETIC BASED SYSTEM AND METHOD FOR ENHANCING SUBSURFACE RECOVERY OF FLUID WITHIN A PERMEABLE FORMATION

CROSS-REFERENCE TO RELATED APPLICATIONS

This application claims priority to Provisional Patent Application Ser. No. 61/090,529 entitled "Electromagnetic Based System and Method For Enhancing Subsurface Recovery of Fluid Within a Permeable Formation" filed Aug. 20, 2008, Provisional Patent Application Ser. No. 61/090,533 entitled "System and Method to Measure and Track Movement of a Fluid in an Oil Well and/or Water Reservoir Using RF Tranmission" filed Aug. 20, 2008, Provisional Patent Application No. Ser. No. 61/090,536 entitled "Sub Surface RF Imaging Using An Antenna Array for Determining Optimal Oil Drilling Site" filed Aug. 20, 2008 and Provisional Patent Application Ser. No. 61/090,542 entitled "RF System and Method for Determining Sub-Surface Geological Features at an Existing Oil Web Site" filed Aug. 20, 2008, the subject matter thereof incorporated by reference in its entirety.

FIELD OF THE INVENTION

This invention relates generally to subsurface fluid recovery systems, and more particularly, to a system and method for recovering oil within a geological strata using electromagnetic transmissions.

BACKGROUND OF THE INVENTION

In the oil production industry, an oil well is typically drilled hundreds or thousands of feet within various geological strata to reach a permeable formation containing an oil reservoir. Such permeable formations include any subsurface or subterranean media through which a fluid (e.g. oil or water) may flow, including but not limited to soils, sands, shales, porous rocks and faults and channels within non-porous rocks. Various techniques may be used to increase or concentrate the amount of fluid such as oil in the area of the reservoir, such area being commonly referred to as an enhanced pool.

Generally, during the initial stage of oil production, the forces of gravity and the naturally existing pressure in a reservoir cause a flow of oil to the production well. Thus, primary recovery refers to recovery of oil from a reservoir by means of the energy initially present in the reservoir at the time of discovery. Over a period of time, the natural pressure of a reservoir may decrease as oil is taken at the production well location. In general, as the pressure differential throughout the reservoir and at the production well location decreases, the flow of oil to the well also decreases. Eventually, the flow of oil to the well will decrease to a point where the amount of oil available from the well no longer justifies the costs of production, which includes the costs of removing and transporting the oil. Many factors may contribute to this diminishing flow, including the volume and pressure of the oil reservoir, the structure, permeability and ambient temperature of the formation. The viscosity of the oil, particularly the oil disposed away from the central portion of the production well, the composition of the crude oil, as well as other characteristics of the oil, play a significant role in decreased oil production.

As the amount of available oil decreases, it may be desirable to enhance oil recovery within an existing reservoir by external means, such as through injection of secondary energy sources such as steam or gas into the reservoir to enhance oil flow to the production well location. Such mechanisms tend to forcibly displace the oil in order to move the oil in the direction of the production well. Such methods may also heat the oil in order to increase the oil temperature and its mobility. Such methods, however, often require drilling additional bore holes into the reservoir, heating the secondary materials and flooding the materials into the reservoir, in addition to post processing requirements for removing and filtering the secondary materials from the recovered oil. All of these contribute to additional production costs. Moreover, existing techniques still do not adequately enable complete recovery of all of the oil within the reservoir. Thus, in many cases, oil recovery may be discontinued despite a substantial amount of oil remaining within the reservoir, because extraction of the remaining oil is too expensive or too difficult given the current recovery methods.

Alternative mechanisms for enhancing oil recovery are desired.

SUMMARY OF THE INVENTION

The invention provides for systems and methods of enhancing crude oil flow by radiating electromagnetic energy in the form of a focused electromagnetic beam into a permeable formation containing the crude oil so as to cause the oil to decrease in viscosity without a substantial change in temperature of the crude oil, thereby increasing the ability of the oil to flow within the formation toward the production well and enabling recovery from the reservoir.

In one embodiment, an array of antennae is configured about (on or below) the surface of the well and positioned so as to propagate electromagnetic (EM) energy through the geological strata and onto the oil within the permeable formation about a focused area at a given frequency and duration, thereby generating in the far field electromagnetic energy impinging on the crude oil to cause a molecular change of the oil molecules, decreasing the viscosity of the affected oil and increasing oil transport to the production well location, without increasing the temperature of the oil. The transmission occurs in the far field without near field losses or interference effects.

In another embodiment, insertion of a fluid or suspension containing catalyst particles such as nanoparticles into the reservoir is accomplished via one or more well bores so as to mix with the crude oil to be harvested. The EM transmitter antennae may then be operated at selected frequencies that correspond to the energy absorption frequency of the catalyst particles to increase their thermal conductivity, enabling the particles to react with the oil molecules in a manner that causes additional motion of crude oil and/or further decrease in the viscosity of the oil.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its applications, or uses.

Figure 1:
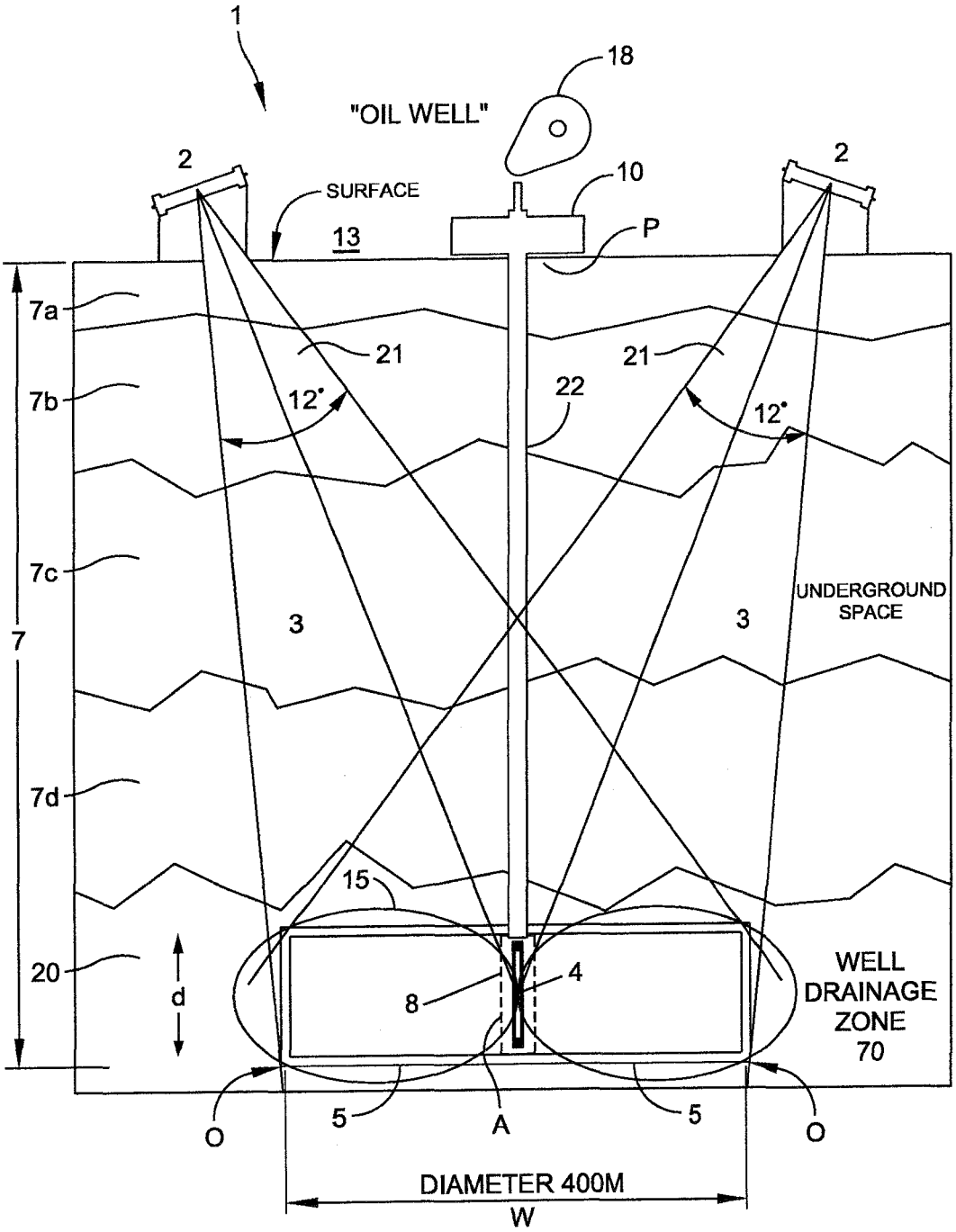
FIG. 1 is a schematic illustration of a system for imparting EM signals into a permeable reservoir formation containing oil to enhance oil flow according to an embodiment of the present invention.

Referring to FIG. 1, there is shown a schematic illustration of a system 1 for imparting EM signals into a permeable reservoir formation containing crude oil to enhance crude oil flow and recovery according to an embodiment of the present invention. As shown in FIG. 1, a production well 10 positioned on the terrain surface is drilled through geological strata indicated generally as 7 to form a borehole 22. As shown, the geological strata 7 may contain multiple layers (e.g. 7*a*, 7*b*, 7*c*, 7*d*) of material, such as soil, rock, shale, sand, water, underground space, and the like. Borehole 22 extends through the strata to a formation layer 20 defining a well drainage zone or reservoir 70 containing crude oil deposits (e.g. crude oil particles) for extraction. A filter casing 8 such as a perforated or mesh structure supporting the borehole is used in combination with a pump 18 to extract and recover the crude oil contained within the reservoir. It is understood that the layer containing the oil to be recovered is volumetric and extends three dimensionally in depth, width and length. Depth (d) is illustrated along the vertical axis and width (w) is illustrated along the horizontal axis as shown in the two dimensional representation depicted in FIG. 1.

A problem encountered as part of the oil production process is that often there exists a rather large horizontal spread of the oil deposit within the well drainage zone 70 as shown in FIG. 1. During initial drilling and oil production, the area A containing oil and located near (adjacent) the casing 8 within the reservoir is most easily extracted from the reservoir. However, at distances more remote from the central location A (e.g. locations nearer the outermost perimeters O of reservoir 70) the oil may have different viscosities. The viscosity of the oil at the more remote locations tends to be much greater than the viscosity of the oil at the central area as a function of the horizontal distance away from the central area A. The difference in viscosity (e.g. relative increase in viscosity) of the oil away from the central A of the reservoir contributes to the difficulties in harvesting such oil, and results in an undesirable amount of oil remaining in the reservoir.

According to an embodiment of the present invention, FIG. 1 shows a compact antenna system 1 comprising an array of antennae 2 positioned at a point (either below or on the ground surface) about the production well 10 at given locations along the terrain surface 13. The antennae are adapted for transmitting in the far field only, electromagnetic energy 15 focused to irradiate the well drainage zone 70 with an aggregate electromagnetic field producing an isotropic profile 5 within the reservoir 70. The aggregate electromagnetic field generated has a frequency and power sufficient to cause a decrease in the viscosity of the oil irradiated within the zone without increasing the temperature of the oil, thereby increasing oil mobility toward the central area of the reservoir. It is understood that electromagnetic energy heats a material only when the frequency of the energy can be absorbed by the molecular structure of the material, thereby "agitating" the structure such that the molecules move about more rapidly in random motion. In the present invention, the processing is performed such that the electromagnetic energy imparted via the EM antennae onto the oil particles or molecules causes the individual oil molecules to join together. Larger molecules in a suspended solution show a lower overall viscosity. According to an aspect of the present invention, the magnetic field component of the transmitted electromagnetic energy beam is sufficient to cause a reaction by the oil molecules to the magnetic portion of the field that reduces the viscosity of oil molecules.

Figure 2:
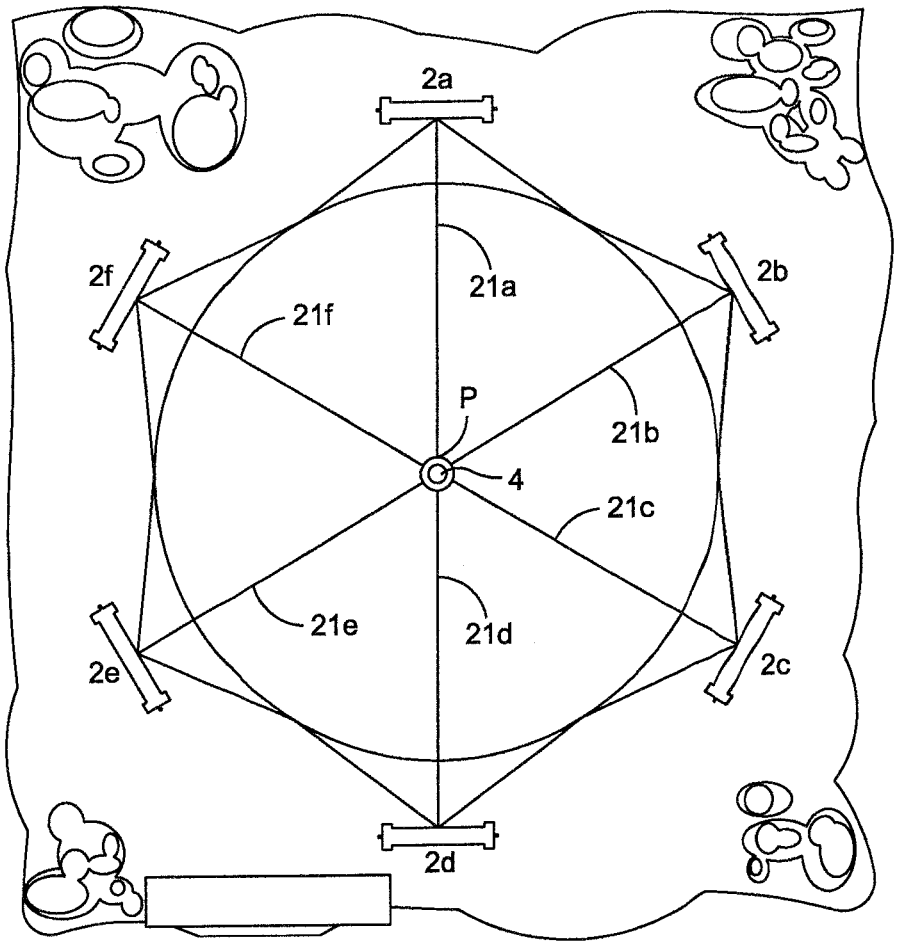
FIG. 2 is a schematic plan view showing the system configuration of FIG. 1 according to an exemplary embodiment.

Referring to FIG. 1 in conjunction with FIG. 2, in an exemplary embodiment, six EM antennae (2*a*, 2*b*, 2*c*, 2*d*, 2*e*, 2*f*) are positioned in uniform fashion about a central location or position P (corresponding for example, to the bore hole 10 location) and directed to transmit in the far field CW or pulsed electromagnetic beams 21*a*-21*f* through the strata to irradiate the well drainage zone 70 without near field losses and/or interference effects. Although 6 antennae are shown, it is understood that more (or less) antennae may be utilized depending on the particular application requirements. Preferably, 10 to 20 antennae may be configured in a given pattern to irradiate a target region at a depth of between 500 ft and 2000 ft. The antennae are configured so as to provide for each beam 21 a directed radiation pattern having a conical profile 3 as shown in FIG. 1. By way of example only, the center of each transmit beam 21 is positioned to intersect at a location 4 within the central area A of the reservoir. The configuration and beam focusing associated with the array of antennae forms an isotropic radiation pattern or profile 5 that covers the drainage zone 70 to thereby increase oil movement in the zone by decreasing the viscosity of the oil due to the impinging EM energy. In a preferred embodiment, the outer 3 dB edge of the intersecting focused EM energy beams covers substantially the entire reservoir zone 70, as best shown in FIG. 1.

In order to enhance movement of the oil within the zone 70 multiple EM antennae are operated as shown in the configuration illustrated in FIG. 2. Compact parametric antennae (CPAs) may be positioned on or below the terrain surface whose beams are to be focused and impart a powerful magnetic field at a depth of the oil reserve to change the viscosity of the oil particles, making them more mobile and enhancing oil recovery from existing oil wells without adding any additional "oil drilling" hardware. The transmit antennae are positioned on (or below) the terrain surface and configured with respect to one another to transmit in the far field continuous wave (CW) or pulsed electromagnetic energy beams through the geological strata to generate an aggregate electromagnetic field having an isotropic profile focused onto the select subsurface region (e.g. the well drainage zone 70) containing the crude oil. The aggregate electromagnetic field impinges upon the crude oil particles at a frequency and energy sufficient to decrease the viscosity of oil particles to enhance crude oil flow within the select subsurface region. A controller 400 (see FIG. 4) provides control parameters for configuring the transmit antennae to transmit the far field electromagnetic beams. The control parameters include one or more of predetermined frequency, power, directivity orientation, and transmit duration parameters. The controller may also operate to steer the beams of the antennae to coalesce and focus within the target region at the desired frequency in order to accomplish the desired decrease in viscosity of the oil particles. Interference of the antenna patterns (constructive and/or destructive interference) may be utilized by the controller to control the output power in orientation and/or frequency at a target depth. The EM energy is focused and applied to the oil at a given frequency, power, and duration so as to decrease the oil viscosity without increasing the temperature of the oil. Controller 400 may be implemented as a digital signal controller (DSC) taking the form of a microcontroller, digital signal processor or other such device programmed to execute instructions for carrying out control functions, including timing functions, data storage and retrieval, and communications between the transmitters and various peripheral devices (e.g. sensors, receivers, monitoring devices, and the like). Controller 400 may be implemented in hardware, firmware, software or combinations thereof, as is understood by one of ordinary skill in the art.

Figure 3:
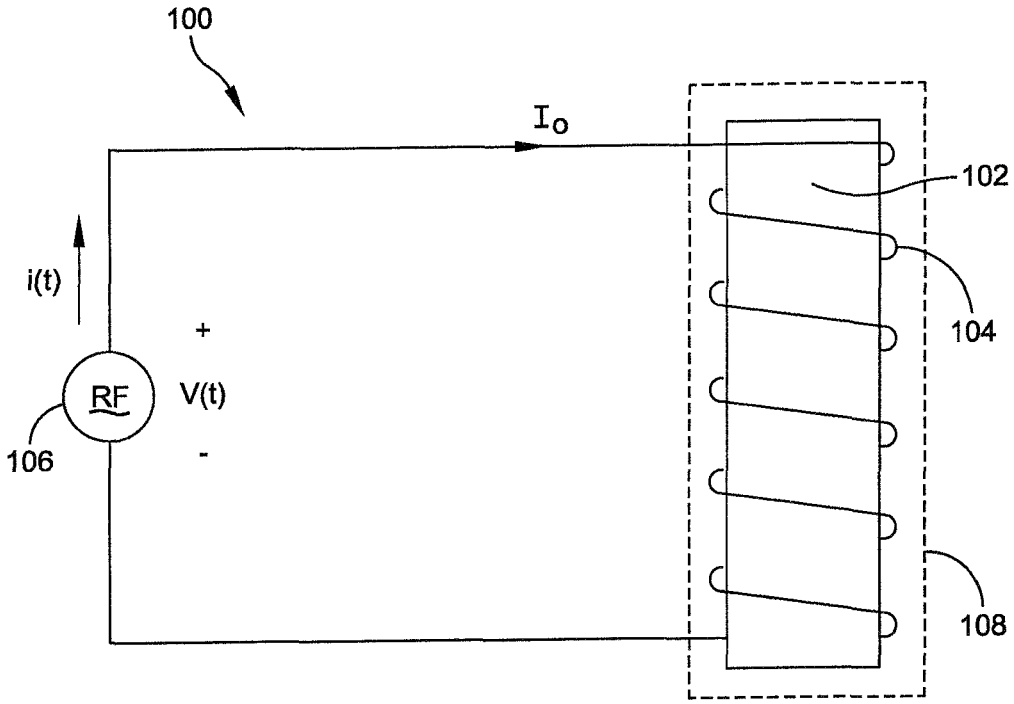
FIG. 3 is an exemplary antenna useful for implementing the present invention.

In a preferred embodiment, an antenna such as the one described in U.S. Pat. No. 5,495,259 entitled "Compact Parametric Antenna", the subject matter thereof incorporated by reference herein in its entirety, may be utilized to form the array of antennae depicted in FIG. 2. Such an exemplary antenna is shown in FIG. 3 and includes a dielectric, magnetically-active mass core 102, ampere windings 104 around mass core 102 and an EM source 106 for driving windings 104. Mass core 102 and windings 104 are preferably housed in an electromagnetic field permeable housing 108, for example, fabricated from fiberglass composite material. In accordance with Poynting vector theory S=E×H the EM current source 106 provides a sinusoidal current $I_0$ which drives the ampere windings 104 to stimulate an external electric field E. Through the induction of gyromagnetic, gyroscopic and Faraday effects in dielectric, magnetically-active, mass core 102, an external magnetic field H having an internal magnetic flux density B is provided, as further described in the aforementioned patent.

Each transmit antenna 2 (FIGS. 1-2) according to an embodiment of the present invention transmits with low loss (i.e. no near field loss) through the various strata including soil, water, rock and the like. That is, the CPA antenna design generates EM with no near field effect. The electromagnetic near field is fully formed within the antenna. The antenna is configured as a mobile antenna arranged in a compact housing that is many times smaller than the wavelength that it transmits (e.g. on the order of hundreds of times smaller). For example, at an antenna operating frequency of 3 kHz, the wavelength is 100,000 meters. Typical antenna systems are designed to be one half (i.e. ½) to one sixth (i.e. ⅙) the length of the wavelength. A CPA antenna operating at 3 kHz can be less than one meter (1 m) in length (or height) with an efficiency of greater than 50%. The antenna is also orientation independent to facilitate placement within various configurations. In one configuration, the antenna core is a mixture of active dielectric and magnetic material. The core material can have a combined magnetic permeability and electric permittivity>25,000. Core particle density (on the order of $10^{12}/cm^3$) are free flowing within the internal magnetic field. Active core material is coherently polarized and aligned with very high efficiency, resulting in very little core Joule heating. In a preferred embodiment, each individual antenna module adds about 6 dB of output Gain (such that an "n" module transmit antenna system adds $2^n$ Gain). For an antenna operating in the low kilohertz range (e.g. 5 kHz), the antenna housing may have a height of about 3 ft. The small size of the antenna package advantageously enables multiple antennae to be configured within a relatively small footprint.

In one non-limiting embodiment, the array of Compact Parametric Antennae is operated by applying electromagnetic energy for at least five minutes at a constant frequency (ranging from 100 Hz to greater than 10 kHz) consistent with good transmission and no near field loss through the intervening strata at an exemplary irradiated power of about 10 kilowatts (kW) to irradiate the oil at a depth defined by the well drainage zone 70. The energy beams propagating from transmit antennae are in the form of a CW or pulsed (i.e. high energy pulses of a given duration) transmission sequence, wherein the power, directivity, and/or frequency of the transmitted magnetic energy may be adjusted to provide a desired change (e.g. increase) in the rate of oil movement and hence oil recovery. In general, the system operates by providing the EM signal such that the aggregate magnetic field from the transmit antennae beams is focused at the depth of the oil reservoir so as to change the viscosity of the oil and make it more mobile, according to the following:

$$H_c = \frac{\lfloor k_B T/(n\mu_f)\rfloor(\mu_p + 2\mu_f)}{a^3(\mu_p - \mu_f)}$$

and $$\tau = \frac{n^{-1/3}}{\upsilon} = \frac{\pi\eta_o(\mu_p + 2\mu_f)^2}{\mu_f n^{5/3} a^5(\mu_p - \mu_f)^2 H^2}$$

wherein $H_c$ represents the threshold magnetic field and where:

$k_B$—Boltzmann's constant

T—Absolute temperature $\mu_p$—Permeability of oil particles in the fluid reservoir $\mu_f$—Permeability of fluid a—radius of oil particle sphere τ—time to aggregate (by way of example, less than 1 minute)

n—Particle number density

H—magnetic field on the particle

ν—Average velocity $\eta_o$—Viscosity

In an exemplary embodiment, the magnetic field transmitted in the far field is about 1 Tesla.

The oil particles or hydrocarbons aggregate when the electromagnetic signal is applied and take a different form such that the particles become more slippery. The aggregation changes the viscosity of the particles and increases their mobility.

Figure 4:
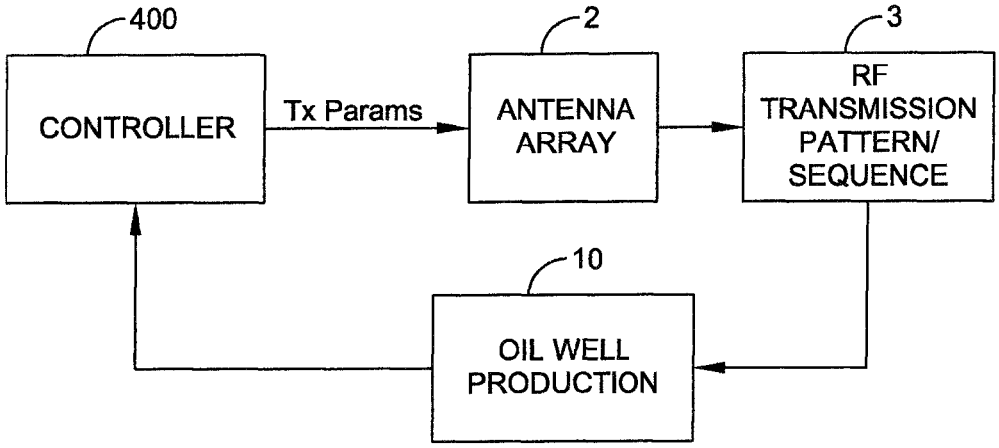
FIG. 4 is an exemplary block diagram illustrating control of the electromagnetic (EM) transmission and oil recovery system of the present invention.

It is further understood with reference to the illustration of FIG. 1 that the antennae may be controlled by means of an arrangement as shown in exemplary fashion by the block diagram of FIG. 4. A controller 400 operates to control the antenna 2 array parameters, including but not limited to frequency, duration, power output, pointing direction, and the like, so as to focus the energy signals 3 at the appropriate depth and level for causing the viscosity of the oil to decrease. A sensor arrangement and/or feedback mechanism may be employed, for example, based on monitoring the oil output from the production well 10, to enable the controller to modify the array parameters according to the well output.

For example, one or more sensors (e.g. fluid sensor) associated with the well bore 22 may be configured to determine and monitor the flow rate of oil recovered from the well bore. A signal from the sensor indicative of the oil flow rate may be communicated to the controller. If the flow rate is less than a predetermined value, the controller may adjust one or more transmit parameters to affect a change in the electromagnetic energy irradiated into the targeted subsurface region for enhancing oil flow. Such adjustments may be performed according to a programmed sequence of parameter adjustments, including but not limited to changes in frequency, directivity, gain, power levels, and target depth, by way of example only. In one configuration, if after a predetermined interval, oil output is not increased (or if the rate of change of oil output drops below a predetermined threshold, for example) the controller 400 may send a signal to modify one or more array parameters to cause a change in the EM signal transmitted to the reservoir. Such change may be monitored and further adjustments made to the EM transmission sequence according to the oil output from the well over a predetermined time interval. In this manner, oil located within the reservoir that would otherwise be too viscous to be harvested, may be irradiated by a magnetic field of sufficient strength, frequency, and duration so as to decrease the viscosity of the crude oil particles and thereby enhance migration of the oil particles to the central area A for extraction by the production well.

Figure 5A:
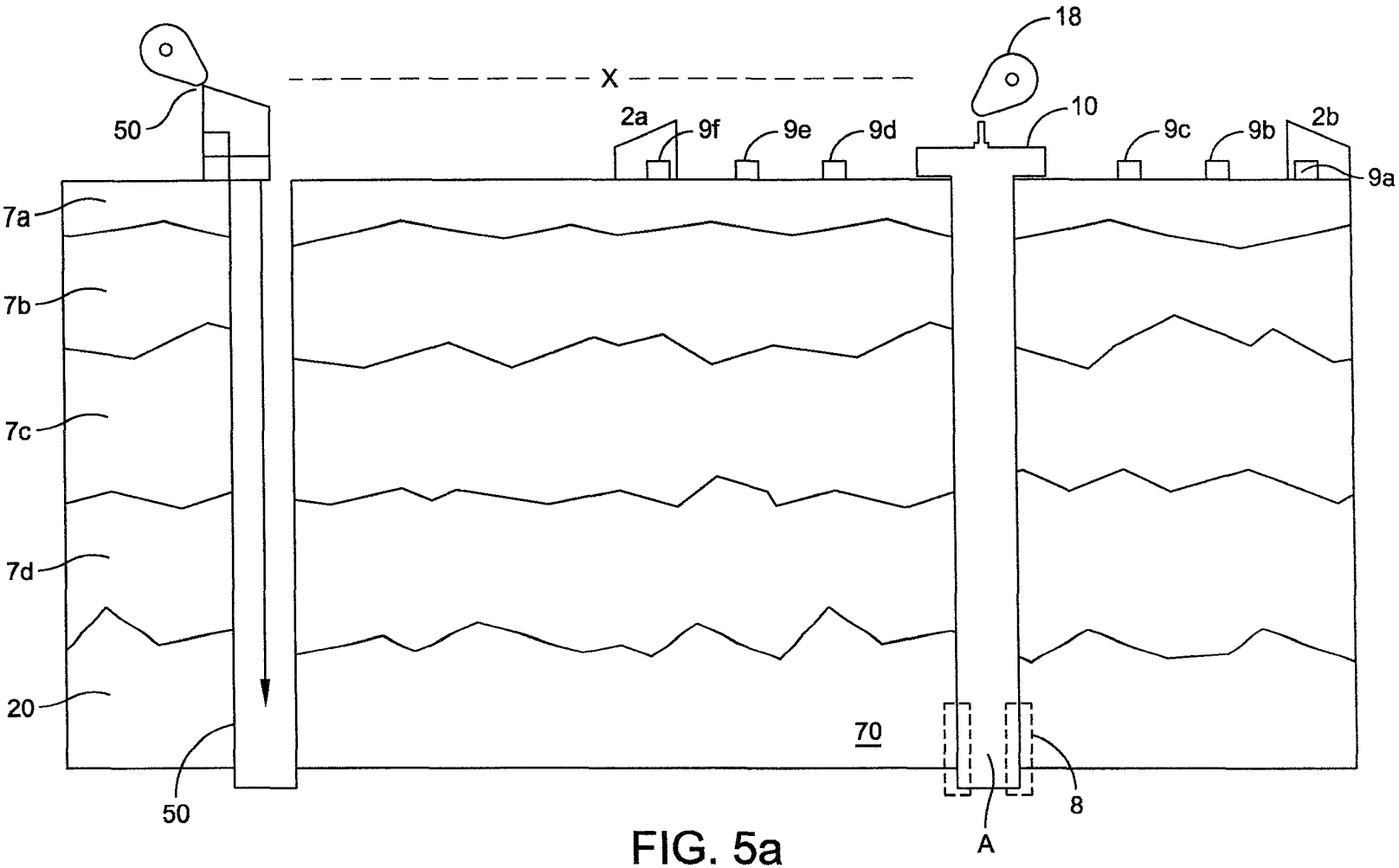
FIG. 5*a* is a schematic illustration of an oil field analogous to that shown in the system of FIG. 1 but further illustrating an auxiliary well typically for imparting secondary energy into the reservoir to enhance oil movement.

FIG. 5*a* shows an exemplary schematic illustration of an oil field analogous to that of FIG. 1 but further containing an auxiliary well 50 or applicator well positioned a predetermined distance x (e.g. 300 feet but may be up to about one thousand feet apart) from production well 10. Like reference numerals are used to indicate like parts. The auxiliary well provides a means for injecting gas or steam into the reservoir for facilitating oil movement toward the central area A. One or more such wells may be placed at locations within the reservoir to facilitate the oil displacement, as is well known in the art. The applicator wells are adapted so as to emit steam or water from the end of the casing (rather than receive fluid from the reservoir) from a source at the surface, thereby displacing the oil in the reservoir toward the central area. In an exemplary embodiment, a nanoparticle-fluid mixture may be injected via the applicator well into the reservoir to facilitate mixing with the crude oil to be harvested. In one configuration the nanoparticles may comprises nano-surfactant particles. The array of antennae may be configured so as to impart EM energy into the mixture. The EM energy field applied may be at a frequency corresponding to the nanoparticle absorption frequency so as to cause the nanoparticles to absorb and re-radiate energy to the oil particles and thereby increase the oil flow within the reservoir. The EM energy field may also be applied so as to heat up the nanoparticles and generate enhanced movement of the oil particles via thermal means. The antenna transmit parameters for exciting the catalyst nanoparticles may be different from those associated with transmission of RF electromagnetic energy sufficient to cause movement of the crude oil resulting from aggregation of the oil molecules, as described above.

Thus, there is disclosed a method for enhancing flow of crude oil particles within a select subsurface region separated from a terrain surface via geological strata. With respect to FIGS. 1-5*a*, the method includes positioning a plurality of transmit antennae 2 on or below the terrain surface 13 in a given pattern relative to the select subsurface region targeted for impingement, and controllably transmitting from the transmit antennae far field continuous wave (CW) or pulsed electromagnetic energy beams 21 of given frequency, power, directivity and duration through the geological strata to generate an aggregate magnetic field 15 having an isotropic profile 5 focused onto the select subsurface region containing the crude oil, wherein the aggregate magnetic field impinges upon the crude oil particles at a target frequency and energy sufficient to decrease the viscosity of the oil particles a given amount to enhance crude oil flow within the select subsurface region. The power and duration of the transmission are controlled so as to decrease the oil viscosity without increasing the temperature of the crude oil. Catalyst particles may be inserted into the select subsurface region containing the crude oil. The catalyst particles may be adapted to interact with the crude oil particles upon excitation and the aggregate magnetic field adapted by adjusting transmit parameters of the antennae to cause excitation of the catalyst particles to thereby impart energy to the crude oil particles to decrease the crude oil particle viscosity. In one embodiment, the catalyst particles are nanoparticles composed of nano-surfactant particles that could function to enhance the reception of electromagnetic energy.

In another configuration, there is provided a system for enhancing crude oil flow within a select subsurface region separated from a terrain surface via geological strata. The system comprises an array of transmit antennae positioned on or below the terrain surface and configured with respect to one another to transmit in the far field only continuous wave (CW) or pulsed electromagnetic energy beams through the geological strata to generate an aggregate magnetic field with isotropic profile focused onto the select subsurface region containing the crude oil. The aggregate magnetic field impinging upon crude oil particles is adapted to be at a frequency and energy level sufficient to cause a decrease in the viscosity of oil particles to enhance crude oil flow within the select subsurface region without increasing the temperature of the crude oil A controller coupled to the transmit antennae provides control parameters for configuring the transmit antennae to transmit the far field electromagnetic beams. The control parameters include one or more of predetermined frequency, power, directivity and transmit duration parameters.

In a preferred embodiment, each transmit antenna of the array of antennae transmits an electromagnetic energy beam having a conical profile. The antennae frequencies range from 100 Hz to 10 kHz. The select subsurface region is separated from the terrain surface by at least five hundred feet (500 ft). The target frequency of the aggregate magnetic field corresponds to a mechanical frequency associated with the oil particles to cause aggregation of said oil particles In a preferred embodiment, each transmit antenna comprises a compact parametric antenna having a dielectric, magnetically-active, open circuit mass core, with ampere windings around the mass core. The mass core is made of magnetically active material (e.g. liquid, powder or gel) that In the aggregate may have a capacitive electric permittivity from about 2 to about 80, an initial permeability from about 5 to about 10,000 and particle sizes from about 2 to about 100 micrometers. An EM source drives the windings to produce an electromagnetic wavefront. Each antenna is configured in a housing having a length of about 3 feet from the terrain surface. The antennae are preferably arranged in a uniform pattern about the well bore on or below the terrain surface. The well bore is in fluid communication with the select region for recovering the crude oil.

In a preferred embodiment, the system further comprises one or more sensors for determining a rate of oil flow recovered from the well bore. The controller is responsive to the determined flow rate from the sensing system for adjusting transmit parameters of the antennae when the flow rate reaches a given threshold.

While the present invention has been described with reference to the disclosed embodiments, it will be appreciated that the scope of the invention is not limited to the disclosed embodiments, and that numerous variations are possible within the scope of the invention.

What is claimed is:

1. A method for enhancing flow of crude oil particles within a select subsurface region separated from a terrain surface via geological strata, the method comprising:

positioning a plurality of transmit antennae on or below the terrain surface in a given pattern relative to the select subsurface region targeted for impingement;

controllably transmitting from said transmit antennae in the far field only, continuous wave (CW) or pulsed electromagnetic energy beams of given frequency, power, directivity and duration through the geological strata to generate an aggregate magnetic field having an isotropic profile focused onto the select subsurface region containing the crude oil, said electromagnetic energy beams transmitted through the geological strata without losses or interference attributable to the near field effects of the electromagnetic energy beams;

wherein the aggregate magnetic field impinges upon the crude oil particles at a target frequency and energy sufficient to decrease the viscosity of said oil particles a given amount to enhance crude oil flow within the select subsurface region.

2. The method of claim 1, further comprising:

providing a well bore from said terrain surface to said select region containing said oil particles and determining a rate of oil flow associated with said select region using said well bore; and adjusting transmission parameters of said antennae according to said determined rate of oil flow.

3. The method of claim 1, wherein the target frequency of the aggregate magnetic field is matched to a mechanical frequency associated with the oil particles to cause aggregation of said oil particles.

4. The method of claim 1, further comprising:

inserting catalyst particles into the select subsurface region containing the crude oil, said catalyst particles adapted to interact with said crude oil particles upon excitation; and modifying the aggregate magnetic field by adjusting transmit parameters of said antennae to cause excitation of said catalyst particles to impart energy to said crude oil particles to decrease said crude oil particle viscosity.

5. The method of claim 4, wherein said catalyst particles are nano surfactant particles.

6. The method of claim 1, wherein the controllably transmitting is performed at frequencies ranging from about 100 Hz to about 10 kHz.

7. The method of claim 6, wherein the power and duration of said transmission are controlled so as to decrease the oil viscosity without increasing the temperature of the crude oil.

8. The method of claim 7, wherein the power transmitted from said antennae is about 10 kilowatts.

9. The method of claim 7, wherein the controllably transmitting electromagnetic energy beams of given frequency, power, directivity and duration through the geological strata to generate the aggregate magnetic field having an isotropic profile focused onto the select subsurface region interacts with said oil reserve according to:

$$H_c = \frac{[k_B T/(n\mu_f)](\mu_p + 2\mu_f)}{a^3(\mu_p - \mu_f)}$$

and $$\tau = \frac{n^{-1/3}}{\upsilon} = \frac{\pi\eta_o(\mu_p + 2\mu_f)^2}{\mu_f n^{5/3} a^5(\mu_p - \mu_f)^2 H^2}$$

wherein $H_c$ represents the threshold magnetic field, and wherein:

$k_B$ is Boltzmann's constant;

T represents the absolute temperature of fluid in select subsurface region; $\mu_p$ represents the permeability of oil particles in the fluid;

$\mu_f$ represents the permeability of fluid;

a represents the radius of an oil particle sphere;

$\tau$ represents the time to aggregate oil particles;

n represents the oil particle number density;

H represents the magnetic field on the oil particles;

$\nu$ represents the average particle velocity;

$\eta_o$ represents the Viscosity of the oil particles in the fluid.

10. The method of claim 7, wherein the controllably transmitting electromagnetic energy beams of given frequency, power, directivity and duration through the geological strata to generate the aggregate magnetic field having an isotropic profile focused onto the select subsurface region further includes time sequencing transmissions of select ones of said antennae, said time sequenced transmissions occurring at a different one or more frequency, power, and directivity relative to others of said antennae to generate overlapping beams that form said aggregate magnetic field having said target frequency and energy sufficient to decrease the viscosity of said oil particles a given amount.

11. A system for enhancing crude oil flow within a select subsurface region separated from a terrain surface via geological strata, the system comprising:

an array of transmit antennae positioned on or below the terrain surface and configured with respect to one another to transmit in the far field only, electromagnetic energy beams through the geological strata to generate an aggregate magnetic field with isotropic profile focused onto the select subsurface region containing the crude oil, the aggregate magnetic field impinging upon crude oil particles at a frequency and energy sufficient to decrease the viscosity of oil particles to enhance crude oil flow within the select subsurface region, said electromagnetic energy beams transmitted through the geological strata without losses or interference attributable to the near field effects of the electromagnetic energy beams; and a controller providing control parameters for configuring said transmit antennae to transmit said far field electromagnetic beams, said control parameters including one or more of predetermined frequency, power, directivity and transmit duration parameters.

12. The system of claim 11, wherein the select subsurface region is separated from the terrain surface by at least five hundred feet.

13. The system of claim 11, wherein each transmit antenna of said array of antennae transmits an electromagnetic energy beam having a conical profile.

14. The system of claim 11, wherein the antennae frequencies range from about 100 Hz to about 10 kHz.

15. The system of claim 14, wherein the controller controls the power and duration of said transmissions so as to decrease the oil without increasing the temperature of the crude oil.

16. The system of claim 15, wherein each of said transmit antennae transmits only in the far field, and wherein the target frequency of the aggregate magnetic field corresponds to a mechanical aggregation frequency associated with the oil particles.

17. The system of claim 15, wherein each of said transmit antennae comprises a compact parametric antenna having a dielectric, magnetically-active, open circuit mass core, ampere windings around said mass core, said mass core being made of magnetically active material that in the aggregate has a capacitive electric permittivity from about 2 to about 80, an initial permeability from about 5 to about 10,000, and particle sizes from about 2 to about 100 micrometers; and an EM source for driving said windings to produce an electromagnetic wavefront.

18. The system of claim 17, wherein each of said antennae has a length of about 3 feet from the terrain surface.

19. The system of claim 17, wherein said antennae are arranged in a uniform pattern about a well bore positioned on or below said terrain surface and in fluid communication with said select region for recovering said crude oil.

20. The system of claim 19, further comprising a sensor system for determining a rate of oil flow recovered from said well bore; said controller responsive to said determined flow rate from said sensing system for adjusting transmit parameters of said antennae when said flow rate reaches a given threshold.

* * * * *